US012291861B2

(12) United States Patent
Mason et al.

(10) Patent No.: US 12,291,861 B2
(45) Date of Patent: May 6, 2025

(54) CONNECTION SYSTEM

(71) Applicant: Illinois Tool Works Inc., Glenview, IL (US)

(72) Inventors: Greg Stephen Mason, Brisbane (AU); Andrew McFarland, Brisbane (AU)

(73) Assignee: Illinois Tool Works Inc., Glenview, IL (US)

( * ) Notice: Subject to any disclaimer, the term of this patent is extended or adjusted under 35 U.S.C. 154(b) by 336 days.

(21) Appl. No.: 17/895,450

(22) Filed: Aug. 25, 2022

(65) Prior Publication Data

US 2023/0068655 A1 Mar. 2, 2023

(51) Int. Cl.
*E04B 1/41* (2006.01)

(52) U.S. Cl.
CPC ..... *E04B 1/4121* (2013.01); *E04B 1/4157* (2013.01); *E04B 2001/4192* (2013.01)

(58) Field of Classification Search
CPC ..... E04B 1/4121; E04B 1/4157; E04B 2001/4192; E04B 1/4128; E04B 1/4135; E05C 5/162; E05C 5/165; E05C 5/166
USPC ..... 52/831
See application file for complete search history.

(56) References Cited

U.S. PATENT DOCUMENTS 923,188 A * 6/1909 Kneas ..... E04B 1/4121 52/708
1,004,226 A * 9/1911 Ahern ..... E04B 1/4128 52/707
1,110,429 A * 9/1914 English ..... E04B 1/4107 52/699
1,110,440 A * 9/1914 Honiss ..... E04B 1/4107 52/707
1,114,013 A * 10/1914 Millar ..... E04B 1/4121 29/451
1,212,990 A * 1/1917 Newhall et al. ..... E04B 1/4107 52/708
1,223,595 A * 4/1917 McMillan et al. .... F16B 13/141 52/705
1,240,993 A * 9/1917 McMillan et al. .... E04B 1/4107 52/708
1,281,416 A * 10/1918 Pratt ..... E04B 1/4107 52/707
1,461,742 A * 7/1923 Tomkinson ..... E04B 1/4142 52/708
1,489,373 A * 4/1924 Tomkinson ..... E04B 1/4121 52/708
1,491,571 A * 4/1924 Tomkinson ..... E04B 1/4107 52/704

(Continued)

FOREIGN PATENT DOCUMENTS

AT 516415 A1 * 5/2016 ..... E04B 1/043
CA 2701165 A1 7/2009

(Continued)

*Primary Examiner* — James M Ference
(74) *Attorney, Agent, or Firm* — Neal, Gerber & Eisenberg LLP

(57) ABSTRACT

A connection system for providing a construction joint between a first concrete component and a second concrete component, the connection system including a rebate former for forming a rebate in a first concrete component, wherein the rebate former is formed of sheet metal, the rebate former including an elongated backing, the elongated backing having folded edges to a predefined depth.

19 Claims, 20 Drawing Sheets

(56) References Cited

U.S. PATENT DOCUMENTS 1,521,658 A * 1/1925 Tomkinson ..... E04B 1/4121 52/704
1,768,246 A * 6/1930 Gaddis ..... E04B 1/4107 52/708
1,769,498 A * 7/1930 Downing ..... F16B 5/0225 52/367
1,922,479 A * 8/1933 Joslin ..... E04B 1/4128 52/704
1,929,835 A * 10/1933 Awbrey ..... F16B 35/06 52/379
1,948,093 A * 2/1934 Baird ..... E04B 1/4121 52/707
2,133,134 A * 10/1938 Davis ..... E04B 1/4107 D25/199
2,181,005 A * 11/1939 Westcott ..... E01C 11/14 404/60
2,194,383 A * 3/1940 Clark ..... E01C 11/08 404/54
2,280,080 A * 4/1942 Predan ..... E04B 1/4128 52/99
2,954,647 A * 10/1960 Lee ..... E04B 1/4157 52/707
3,095,672 A * 7/1963 Di Tullio ..... E04B 1/4107 411/116
3,405,497 A * 10/1968 McNair ..... E04B 1/4121 52/704
3,449,883 A * 6/1969 Juten ..... E04B 1/4107 52/852
3,559,541 A * 2/1971 Watstein ..... E01C 11/14 404/60
3,694,012 A * 9/1972 Gelfand ..... E04C 5/165 403/313
3,722,165 A * 3/1973 Forsberg ..... E04B 1/4121 52/704
3,744,659 A * 7/1973 Koehler ..... B65D 21/08 144/136.9
3,982,363 A * 9/1976 Dorris ..... E04B 1/4121 411/908
4,469,465 A * 9/1984 Andrus ..... E04C 5/165 403/312
4,905,444 A * 3/1990 Semaan ..... E04B 2/94 52/235
5,230,191 A * 7/1993 Mayrand ..... B28B 7/0088 52/331
5,261,635 A * 11/1993 Flathau ..... B28B 23/00 249/7
5,487,249 A * 1/1996 Shaw ..... E04B 1/483 52/704
5,548,939 A * 8/1996 Carmical ..... E04B 1/4135 52/707
5,623,804 A * 4/1997 Kelly ..... E04B 1/4128 52/707
5,625,993 A * 5/1997 Kelly ..... E04C 5/16 52/704
5,635,097 A * 6/1997 Aiello ..... E04G 11/365 249/43
5,809,703 A * 9/1998 Kelly ..... E04B 1/4107 52/707
5,813,185 A * 9/1998 Jackson ..... E04G 17/0657 52/405.1
6,065,263 A * 5/2000 Taguchi ..... F16B 7/06 52/583.1
6,219,991 B1 * 4/2001 Salek-Nejad ..... E04C 5/07 264/32
6,279,274 B1 * 8/2001 Amiet ..... E04C 5/20 52/125.4
7,967,527 B2 * 6/2011 Estes ..... E01C 11/14 404/58
8,647,542 B2 * 2/2014 Zakaras ..... F16B 19/02 249/83
8,966,833 B2 * 3/2015 Ally ..... E04B 1/41 52/125.4
9,574,340 B1 * 2/2017 Scoggins ..... E02D 27/42
11,067,205 B2 * 7/2021 Iwamoto ..... F16L 15/06
11,788,314 B2 * 10/2023 Mashal ..... E04H 9/0237 52/167.1
2007/0039281 A1 * 2/2007 Zambelli ..... E04B 1/4107 52/125.5
2007/0189707 A1 * 8/2007 Zakaras ..... E04C 5/161 385/147
2012/0192506 A1 * 8/2012 King ..... E04B 1/043 52/125.4
2015/0204026 A1 * 7/2015 McDonald ..... E04B 1/48 404/60
2019/0024375 A1 * 1/2019 Murdoch ..... E04C 5/165
2023/0068655 A1 * 3/2023 Mason ..... E04G 21/125

FOREIGN PATENT DOCUMENTS

DE 3737645 A1 * 5/1989
EP 0121510 A2 * 10/1984
EP 1389648 A1 2/2004
WO 9828500 A1 7/1998
WO WO-2014026024 A1 * 2/2014 ..... E04C 5/165

* cited by examiner

| Connection Mark RB2 - N20/20mm Anchorage Capacity Check | | | |
|---|---|---|---|
| Anchor System | ReidBar Threaded Inserts | Other Ferrules (Calc) | Other Foot Anchors (Calc) |
| Connection Mark | RB2 | TS2 | FA2 |
| Rebar Anchor / ReidBar Detail | RBA20TI-400C | TS20-300C | FA20-300 |
| No. Connections per metre | 2.5 (400 mm centres) | 3.3 (300 mm centres) | 3.3 (300 mm centres) |
| Tensile Capacity ΦNc (kN/anchor) | 140.1 (125.6*) | 54.0 | 57.9 |
| Tensile Capacity ΦNc (kN/metre) | 350.3 (314.0*) | 178.2 | 191.1 |

Ours 350.3 178.2 Others

*Figure 20*

Design Capacity

Steel and Ductile Cast Iron Threaded Inserts, In-Concrete Design Capacity

*Characteristic Values of resistance Anchorage, NZS 3101:2006 A3 (Cl 8.6.11.1 & Cl 8.6.11.2)

Concrete Cone Failure in Non-Cracked Concrete f'c = 40 MPa

| RBar Size | Part Number | Installation details | Eff've depth h (mm) | Min Edge Dist e (mm) | Min Conc thick b (mm) | Cap. Red'n Fctr, Φc | Characteristic Ultimate Tensile Capacity | | | | | | | |
|---|---|---|---|---|---|---|---|---|---|---|---|---|---|---|
| | | | | | | | Concrete Cone Failure | | | | | | | |
| | | | | | | | Tension N (kN) per anchor | | | | | | | |
| | | | | | | | Anchor Spacing, a (mm) | | | | | | | |
| | | | | | | | 150 | 200 | 250 | 300 | 350 | 400 | 450 | 500 |
| 12 | RB12TI | 8mm thick Nailing Plate & EPCON C8 | 104 | 150 | 150 | 0.65 | 39.1 | 52.1 | 65.1 | 79.1 | 83.7 | 83.7 | 83.7 | 83.7 |
| 16 | RBA16TI | | 121 | 180 | 200 | | 43.2 | 57.6 | 72.0 | 86.4 | 113.1 | 113.1 | 113.1 | 113.1 |
| 20 | RB20TI | | 151 | 240 | 200 | | 48.6 | 64.8 | 81.0 | 97.2 | 113.3 | 129.5 | 145.7 | 146.7 |

Concrete Cone Failure in Cracked Concrete f'c = 40 MPa

| RBar Size | Part Number | Installation details | Eff've depth h (mm) | Min Edge Dist e (mm) | Min Conc thick b (mm) | Cap. Red'n Fctr, Φc | Characteristic Ultimate Tensile Capacity | | | | | | | |
|---|---|---|---|---|---|---|---|---|---|---|---|---|---|---|
| | | | | | | | Concrete Cone Failure | | | | | | | |
| | | | | | | | Tension N (kN) per anchor | | | | | | | |
| | | | | | | | Anchor Spacing, a (mm) | | | | | | | |
| | | | | | | | 150 | 200 | 250 | 300 | 350 | 400 | 450 | 500 |
| 12 | RB12TI | 8mm thick Nailing Plate & EPCON C8 | 104 | 150 | 150 | 0.65 | 31.2 | 41.7 | 52.1 | 63.0 | 66.1 | 66.1 | 66.1 | 66.1 |
| 16 | RBA16TI | | 121 | 180 | 200 | | 34.6 | 46.1 | 57.6 | 69.1 | 71.2 | 71.2 | 71.2 | 71.2 |
| 20 | RB20TI | | 151 | 240 | 200 | | 38.9 | 51.8 | 64.8 | 77.7 | 90.7 | 103.6 | 116.6 | 117.4 |

*Figure 21*

| Threaded Inserts used alone as anchorage in Non-Cracked f'c = 40 MPa | | | | | | | | |
|---|---|---|---|---|---|---|---|---|
| RBar Size | Part Number | Installation details | Eff've depth h (mm) | Min Edge Dist e (mm) | Min Conc thick b (mm) | Cap. Red'n Fctr, Φc | Gr500E ReidBar 1.5xf (kN) as per NZS3101:2006 (A3) C18.6.11.2 | Characteristic Ultimate Tensile Capacity<br>Single Anchor Capacity without damage to concrete<br>Tension N (kN) per anchor |
| 12 | RB12TI | 8mm thick Nailing Plate & EPCON C8 | 104 | 160 | 150 | 0.65 | 84.7 | 84.7 |
| 16 | RBA16TI | 42mm deep rebate & EPCON C8 | 155 | 240 | 200 | | 150.8 | 150.8 |
| 20 | RB20TI | 67mm deep rebate & EPCON C8 | 210 | 315 | 250 | | 235.5 | 235.5 |

*Figure 21 (continued)*

Wall and floor connections
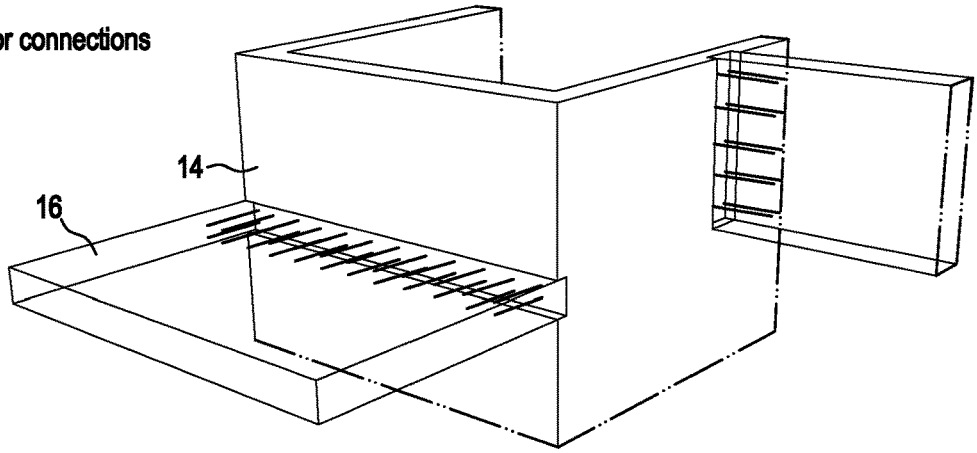
Stair and landing connections to walls
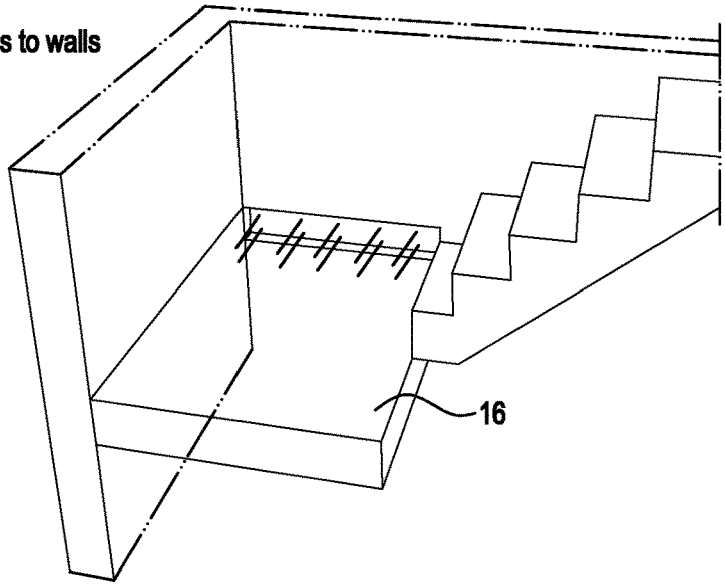
Slab to slab connections
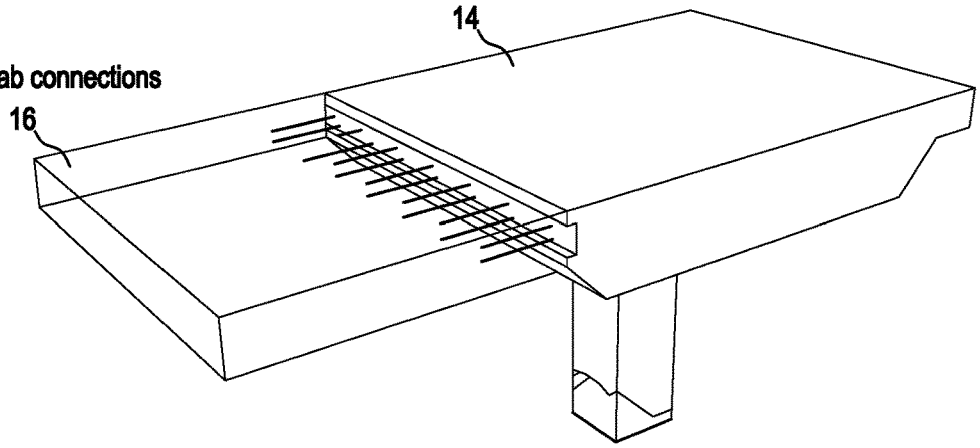
*Figure 28*

CONNECTION SYSTEM

PRIORITY CLAIM

The present application claims priority to and the benefit of Australian Patent Application No. 2021221844, filed Aug. 25, 2021, the entire contents of which are incorporated herein by reference.

FIELD

The present disclosure relates to construction and to a connection system, for example for connecting reinforcement of a floor to a wall prior to pouring concrete of the floor. The present disclosure may also relate to a rebate former for construction. More particularly, but not exclusively, the present disclosure relates to a rebate former for forming a rebate in a concrete component for floor and/or wall connections.

BACKGROUND

It has been previously proposed to provide a connection system including a rebate box for providing a structural connection between concrete components. However, existing connection systems may be difficult to use, require a dense population of reinforcement anchorages and yet provide relatively low tensile capacity.

It would be advantageous to provide an improved connection system for providing a structural connection between concrete components, which addresses one or more of the disadvantages of existing connection systems.

Examples of the present disclosure seek to provide an improved connection system which obviates or at least alleviates one or more disadvantages of existing connection systems, or at least to provide a useful alternative.

SUMMARY

In accordance with one aspect of the present disclosure there is provided a connection system for providing a construction joint between a first concrete component and a second concrete component. The connection system includes a rebate former for forming a rebate in a first concrete component, wherein the rebate former is formed of sheet metal, the rebate former including an elongated backing, the elongated backing having folded edges to a predefined depth.

Preferably, the connection system includes a plurality of anchors coupled to the elongated backing, each of the anchors having an internal thread for receiving an external thread of a reinforcing bar for reinforcing a second concrete component.

Preferably, each of the anchors has a foot for providing anchorage in the first concrete component. More preferably, the foot is a tapered foot. Even more preferably, the foot is in the form of a circular tapered foot.

In a preferred form, each of the anchors has one or more external ribs along a length of the anchor for providing anchorage in the first concrete component. More preferably, each of the external ribs is tapered outwardly toward a free end of the anchor. Even more preferably, each of the anchors is in the form of a threaded insert.

In a preferred form, the rebate former has folded ends to provide structural rigidity.

Preferably, the connection system includes a lid for covering an internal cavity of the rebate former defined by the elongated backing and the folded edges. More preferably, the connection system includes at least one strap extending around the rebate former and the lid to secure the lid to the rebate former.

In one form, the rebate former includes a row of anchors mounted longitudinally of the rebate former. More preferably, the rebate former includes a plurality of parallel rows of anchors mounted longitudinally of the rebate former.

Preferably, the connection system includes a plurality of parallel rebate formers joined by an intermediate section. More preferably, each rebate former has a plurality of rows of anchors mounted thereto.

In a preferred form, the rebate former includes a cross strut extending across a width of the internal cavity of the rebate former. More preferably, the cross strut is in the form of a brace which is movable along a length of the rebate former.

Preferably, each anchor is provided with a securing plug, the securing plug having an external thread for threading into the internal thread of the anchor. More preferably, the securing plug has an external thread having the same pitch as the external thread of a reinforcing bar for threading into the female thread of the anchor. Even more preferably, the securing plug is arranged with an enlarged base to facilitate threading manually by hand. In one form, the securing plug is formed of plastic material.

Preferably, the connection system includes a resilient washer located between the securing plug and the respective anchor to facilitate a seal of the internal thread of the anchor against ingress of concrete.

In one form, the rebate former is dimpled on the backing and on the folded edges to facilitate retention of the rebate former within surrounding concrete.

Preferably, the connection system includes a threaded reinforcing bar threaded into each anchor, with an external thread of the threaded reinforcing bar mating with an internal thread of the anchor.

In accordance with another aspect of the present disclosure, there is provided a method of providing a construction joint between a first concrete component and a second concrete component, the method including: (1) providing a connection system including a rebate former for forming a rebate in the first concrete component, wherein the rebate former is formed of sheet metal, the rebate former including an elongated backing, the elongated backing having folded edges to a predefined depth; (2) providing a plurality of anchors coupled to the elongated backing, each of the anchors having an internal thread; (3) providing a plurality of reinforcing bars, each of the reinforcing bars having an external thread along its length; and (4) threading one of the reinforcing bars into each of the anchors such that, for each anchor, an external thread of a reinforcing bar is threaded into the internal thread of the anchor to tighten the reinforcing bar relative to the anchor for providing reinforcement for the second concrete component.

BRIEF DESCRIPTION OF THE DRAWINGS

The present disclosure is further described by way of non-limiting example only, with reference to the accompanying drawings in which:

FIG. 20 shows a table with anchorage capacity results of different anchors;

FIG. 21 shows a table of Design Capacity;

FIG. 28 shows a range of example connections;

DETAILED DESCRIPTION

Figure 1:
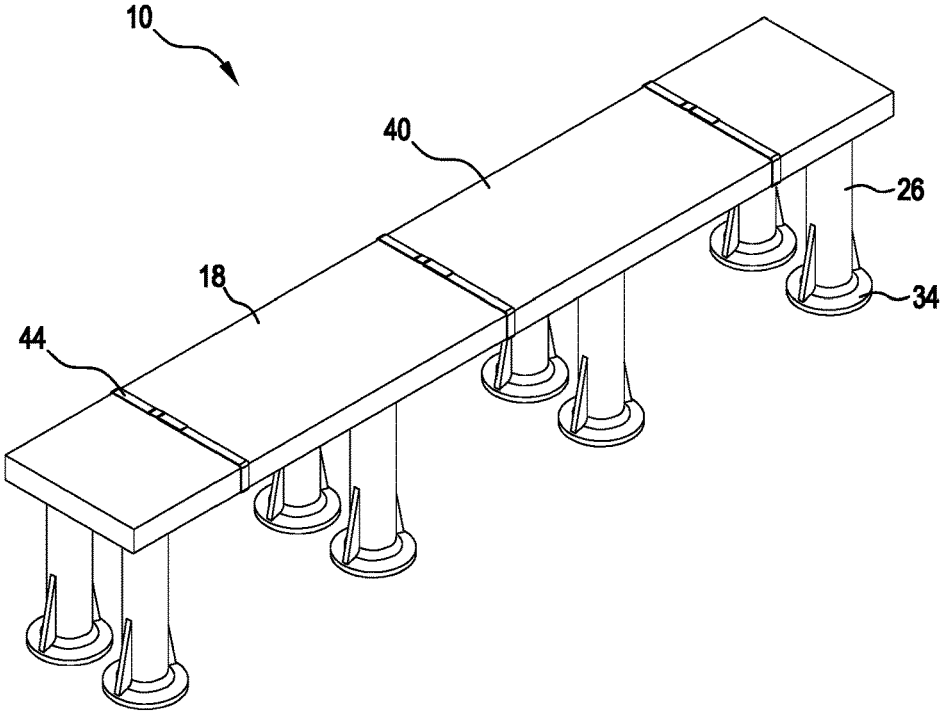
FIG. 1 is a perspective view of a connection system in accordance with an example embodiment of the present disclosure, shown prior to embedment in concrete components.
Figure 2:
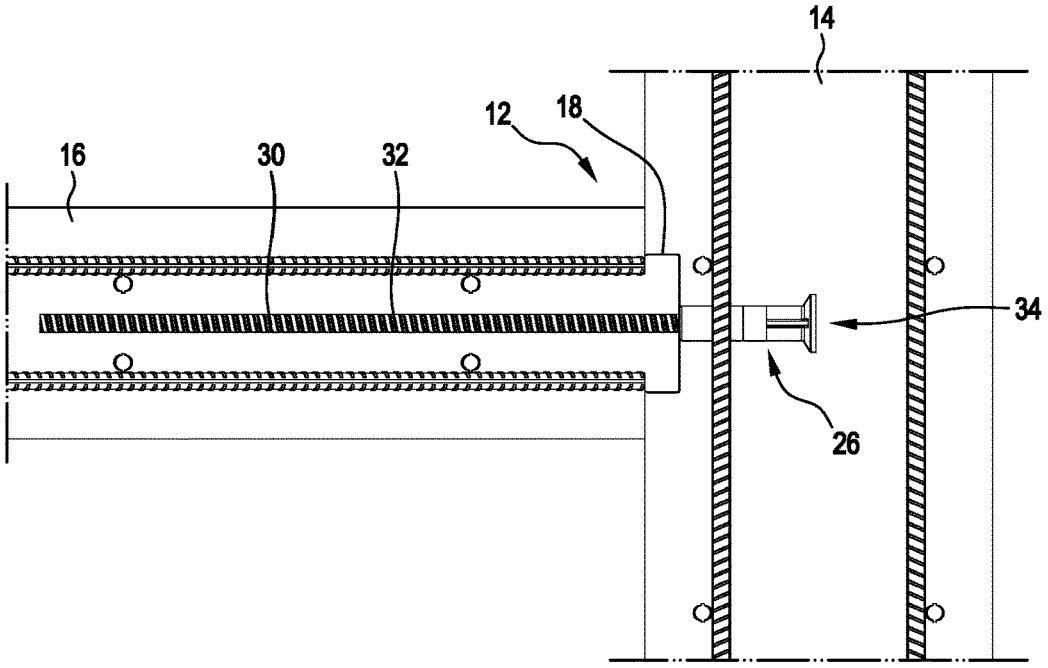
FIG. 2 is a cross-sectional view of a connection system in accordance with an example embodiment of the present disclosure, forming a structural connection between two concrete components.
Figure 3:
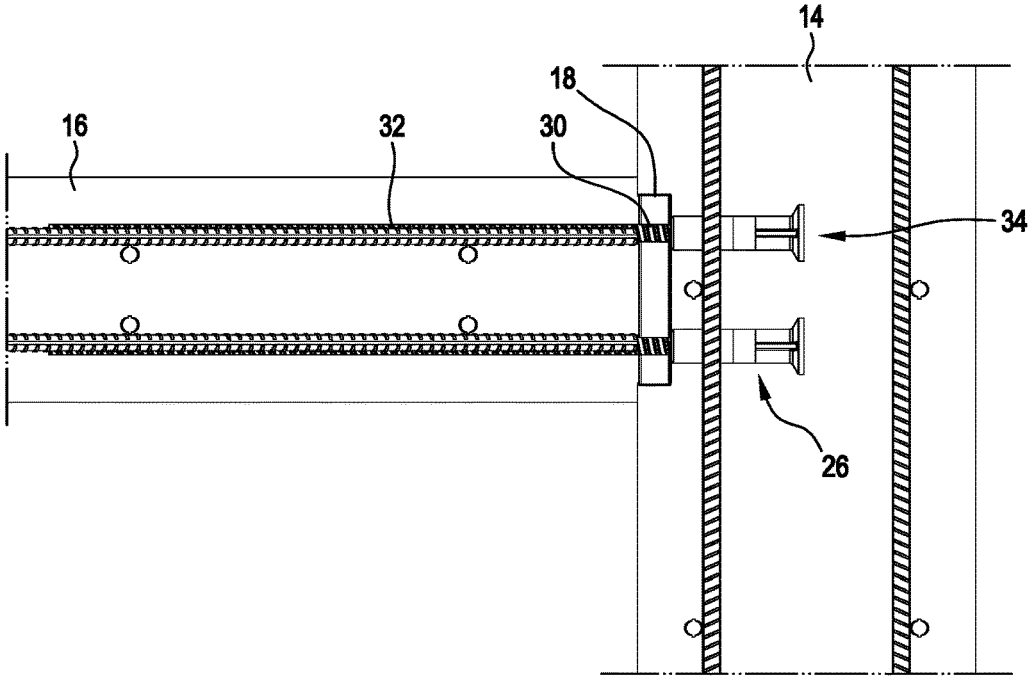
FIG. 3 is a cross-sectional view of a connection system having a rebate former with parallel rows of anchors.

While the features, devices, and apparatus described herein may be embodied in various forms, the drawings show, and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

With reference to FIGS. 1 to 34, there is shown various example embodiments of a connection system 10. Advantageously, the connection system 10 has been developed by the applicant to facilitate improved rigidity, ease-of-use, efficiency, and improved load-bearing capacity.

More specifically, as shown in the drawings, an example of the present disclosure provides a connection system 10 for providing a construction joint 12 between a first concrete component 14 and a second concrete component 16. The connection system 10 includes a rebate former 18 for forming a rebate 20 (see FIG. 17) in the first concrete component 14. The rebate former 18 is formed of sheet metal, the rebate former 18 including an elongated backing 22, the elongated backing 22 having folded edges 24 to a predefined depth.

Figure 8:
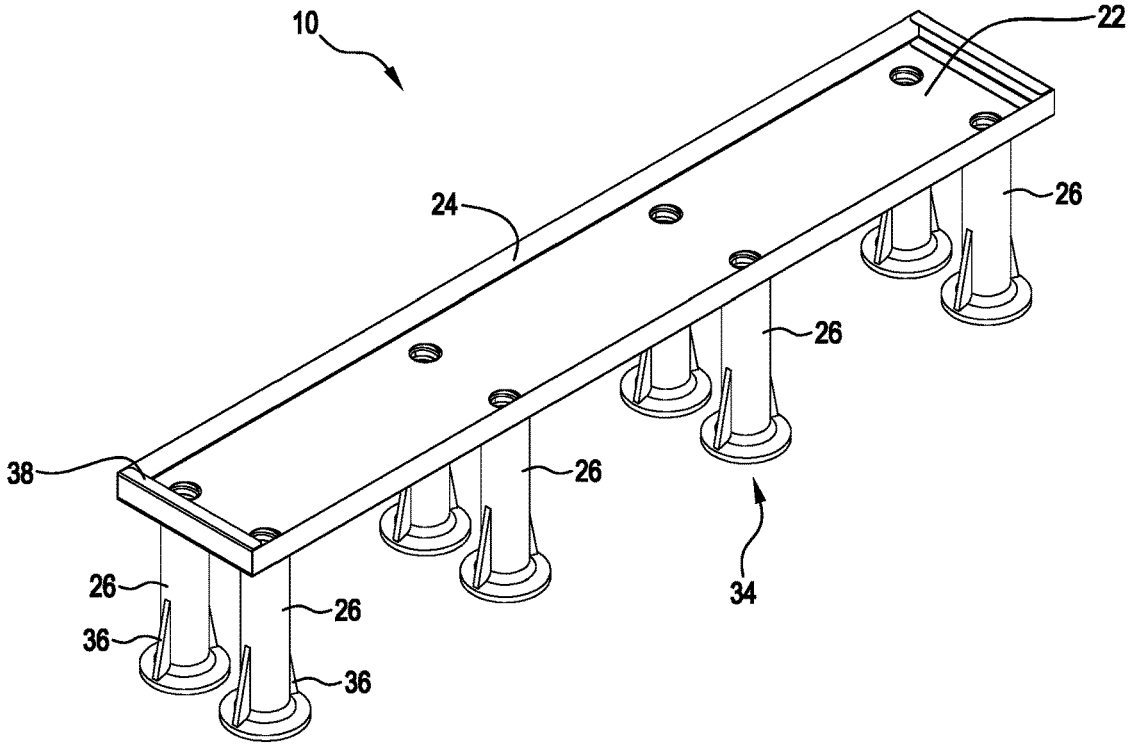
FIG. 8 is a perspective view of a connection system having parallel rows of anchors.
Figure 9:
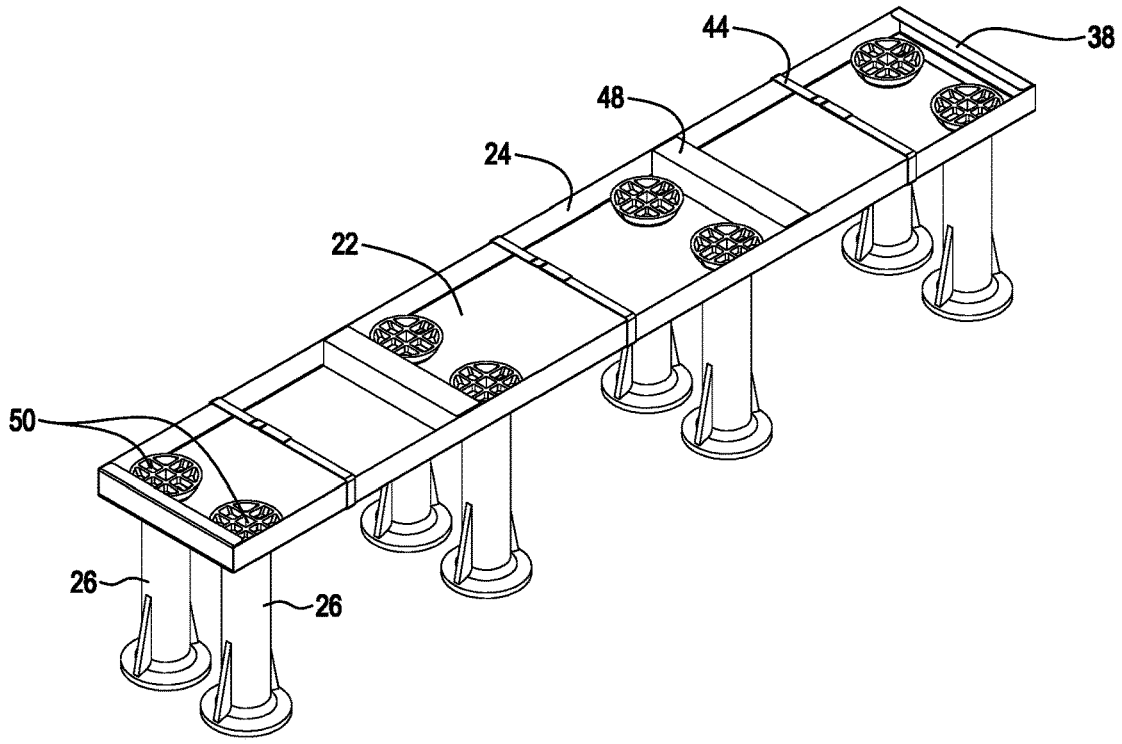
FIG. 9 is a perspective view of the connection system of FIG. 8, shown fitted with threaded plugs.
Figure 10:
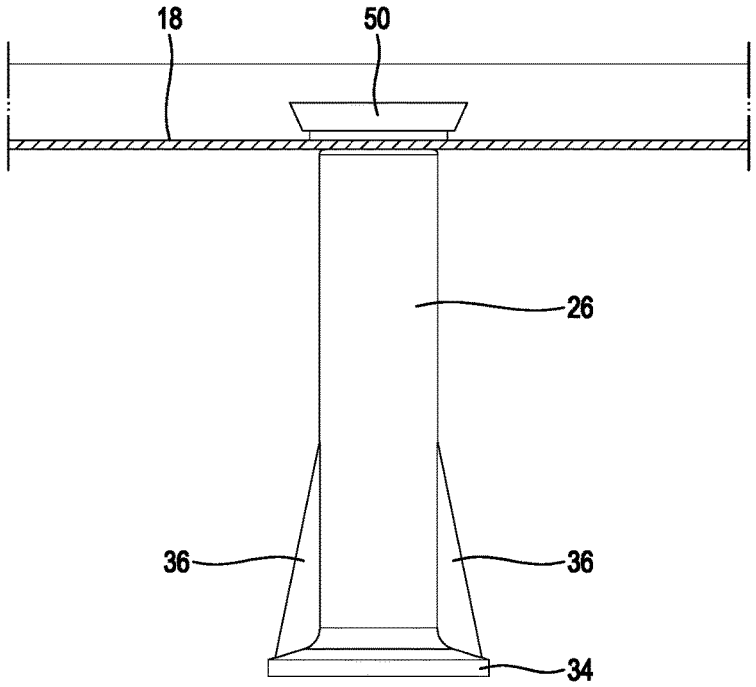
FIG. 10 shows a detailed side view of an anchor of the connection system shown in FIG. 9.
Figure 11:
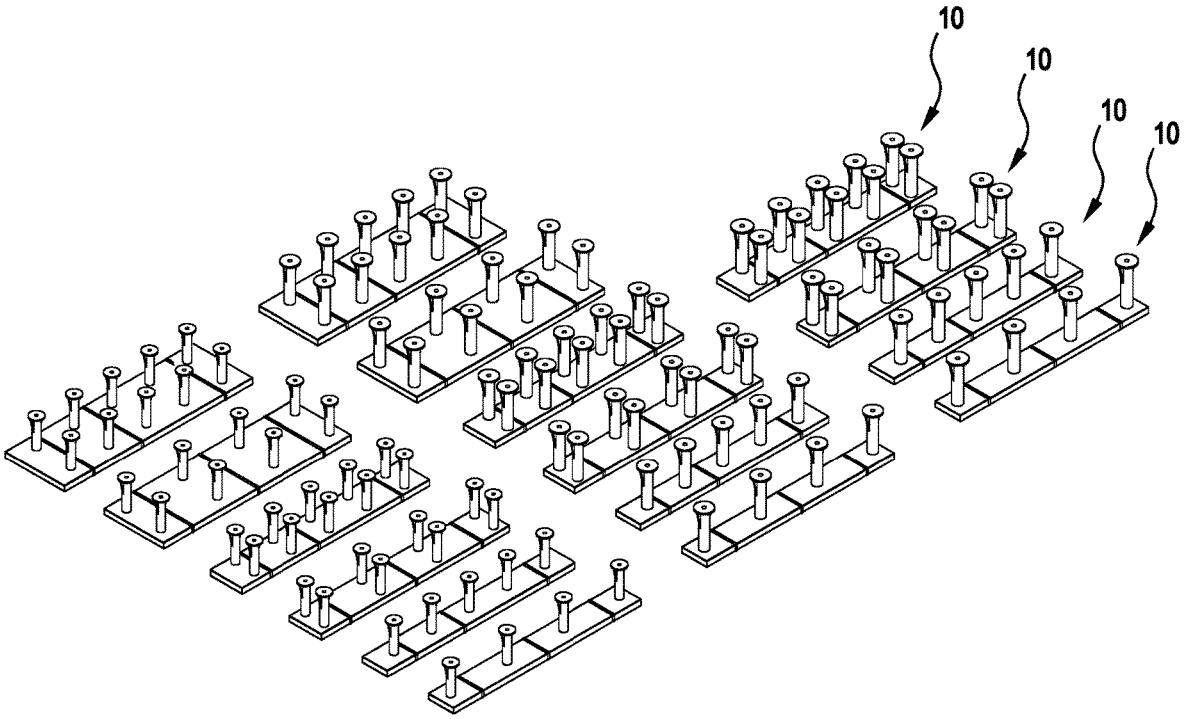
FIG. 11 shows a range of different configurations of connection systems.
Figure 30:
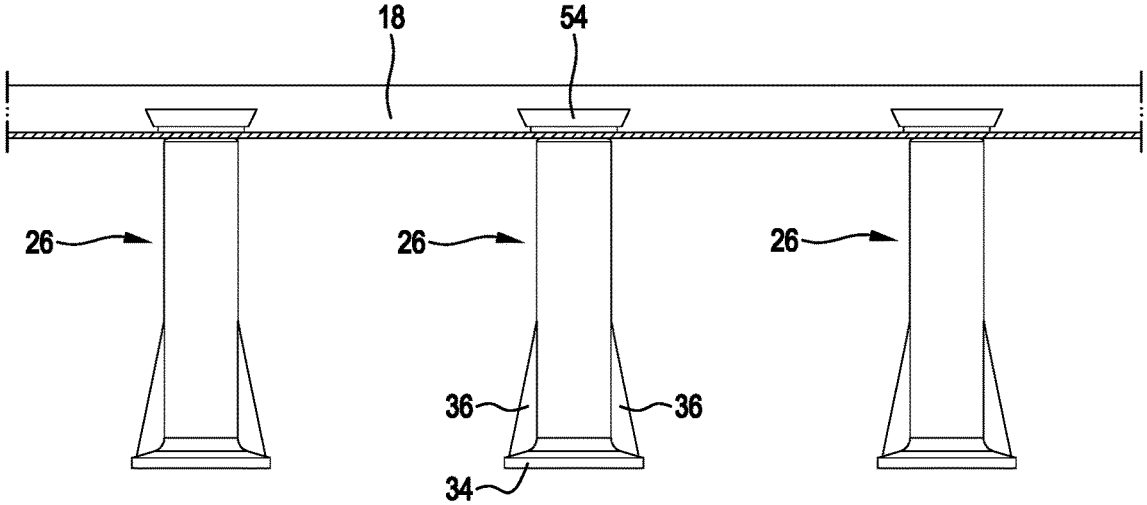
FIG. 30 shows a side view of a connection system with a plug fitted to each anchor.
Figure 30A:
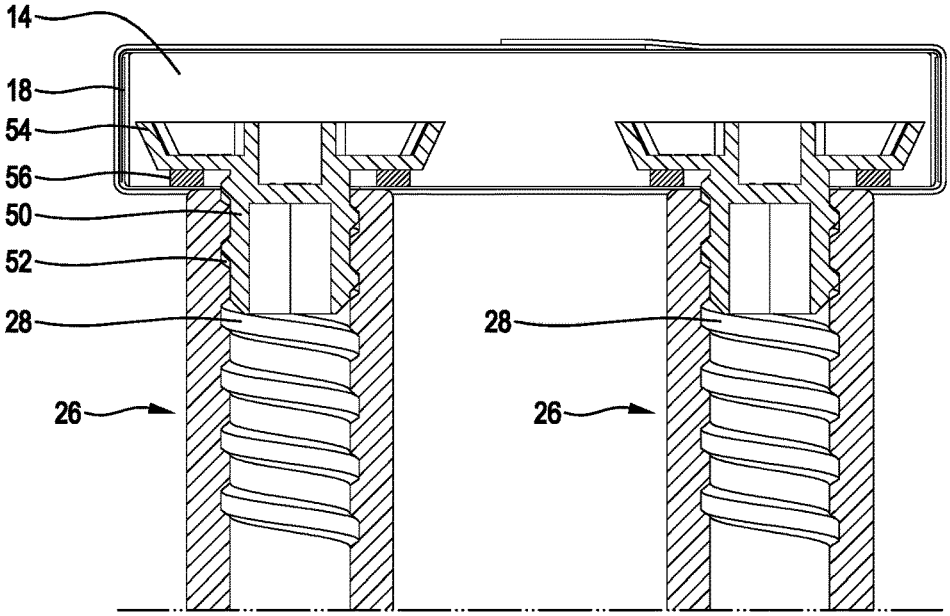
FIG. 30*a* shows a cross-sectional view of a plug fitted to each anchor.
Figure 31:
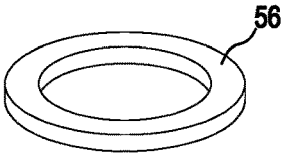
FIG. 31 shows a perspective view of a resilient washer/seal.

As shown clearly in FIGS. 8 and 9, the connection system 10 includes a plurality of anchors 26 coupled to the elongated backing 22. Each of the anchors 26 as an internal thread 28 (see FIG. 30*a*) for receiving an external thread 30 of a reinforcing bar 32 for reinforcing the second concrete component 16.

Each of the anchors 26 has a foot 34 for providing anchorage in the first concrete component 14. The foot may be in the form of a tapered foot 34. Even more specifically, the foot may be in the form of a circular tapered foot 34.

Figure 7:
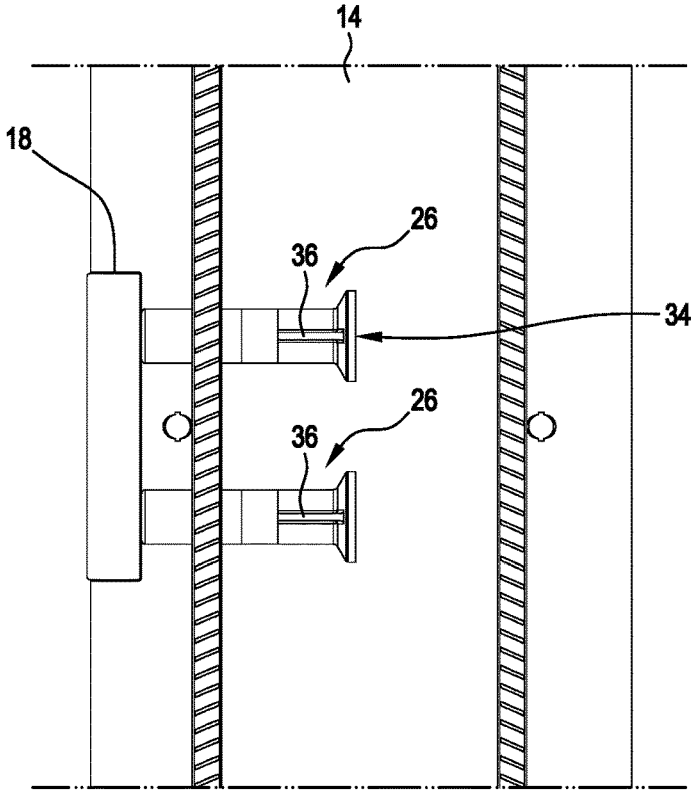
FIG. 7 is an end view of a connection system, depicted prior to connecting reinforcing bars to the anchors.

As can be seen in FIG. 7, each of the anchors 26 has one or more external ribs 36 along a length of the anchor 26 for providing anchorage in the first concrete component 14. Each of the external ribs 36 may be tapered outwardly toward a free end of the anchor 26. Each of the anchors 26 may be in the form of a threaded insert.

The rebate former 18 may have one or more folded ends 38 to provide structural rigidity.

The connection system 10 may include a lid 40 for covering an internal cavity 42 of the rebate former 18 defined by the elongated backing 22 and the folded edges 24. The connection system 10 may include at least one strap 44 extending around the rebate former 18 and the lid 40 to secure the lid 40 to the rebate former 18. Alternatively, with reference to FIG. 6 and FIG. 9, straps 44 may instead be used around the rebate former 18 without the lid 40 fitted.

Figure 12:
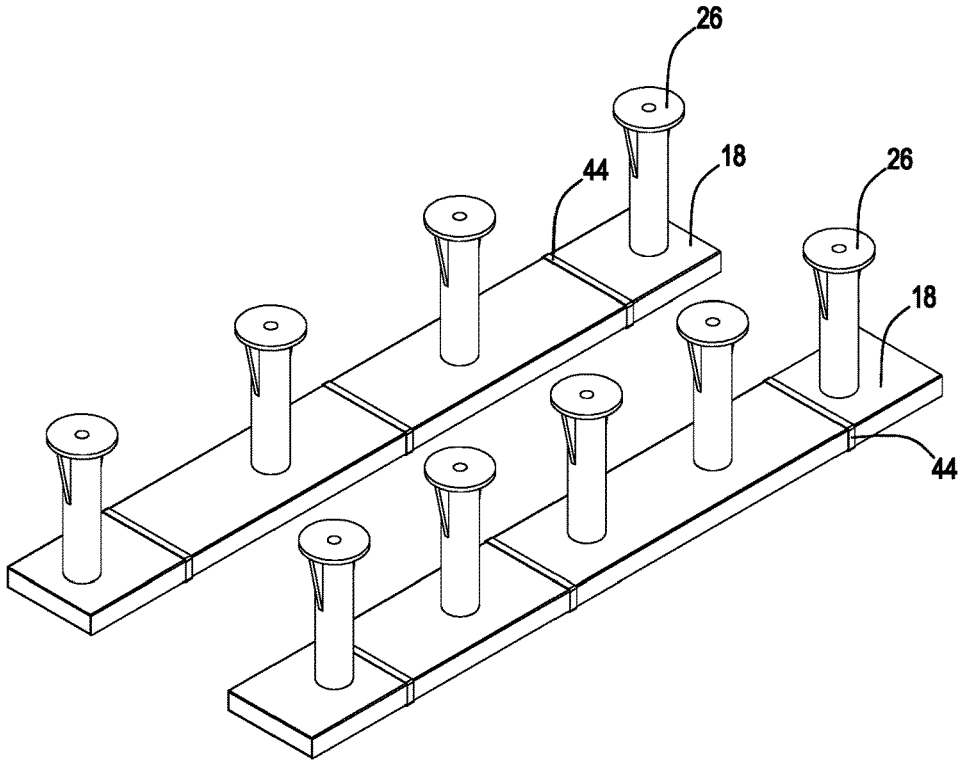
FIG. 12 shows a pair of rebate formers, each with a single row of anchors.
Figure 13:
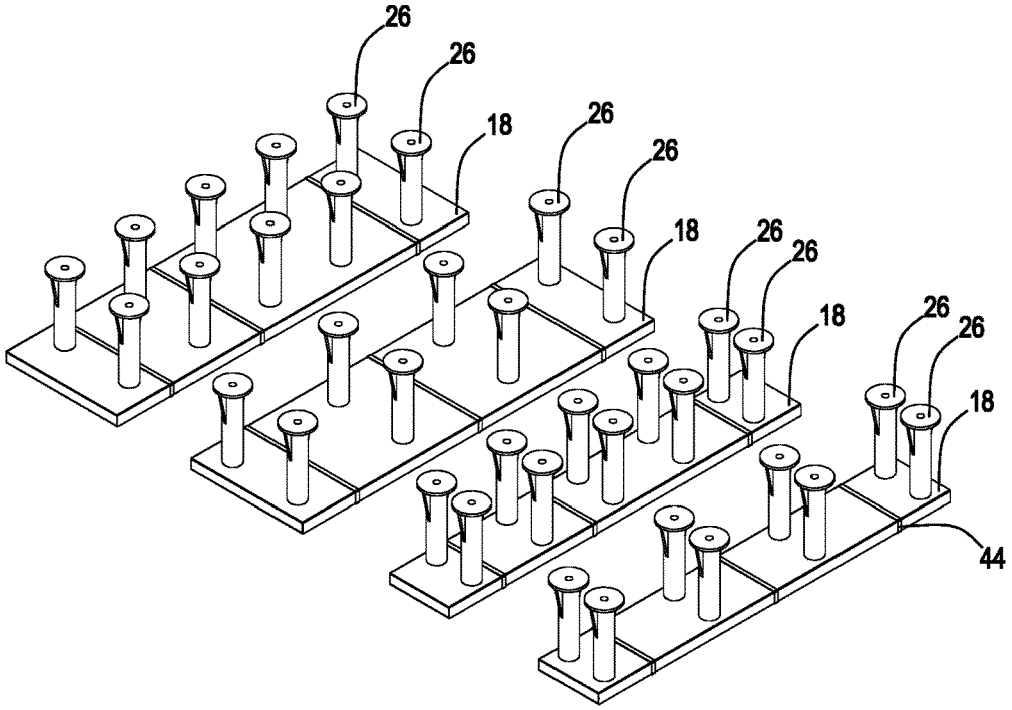
FIG. 13 shows a plurality of rebate formers, each with a pair of anchor rows.
Figure 14:
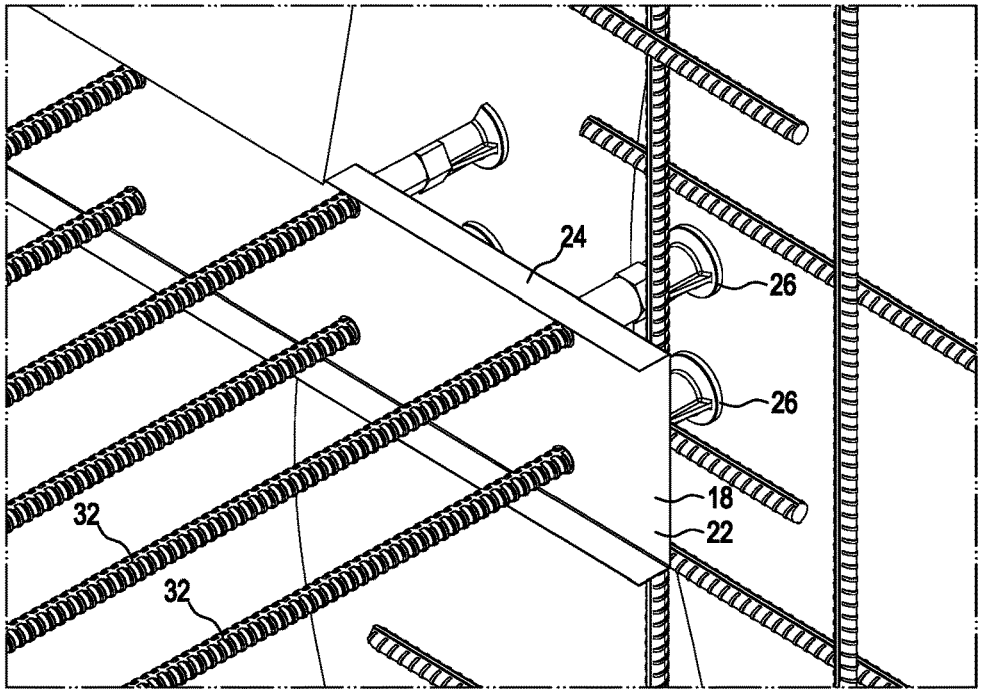
FIG. 14 shows a connection system having reinforcing bars connected to anchors thereof.
Figure 15:
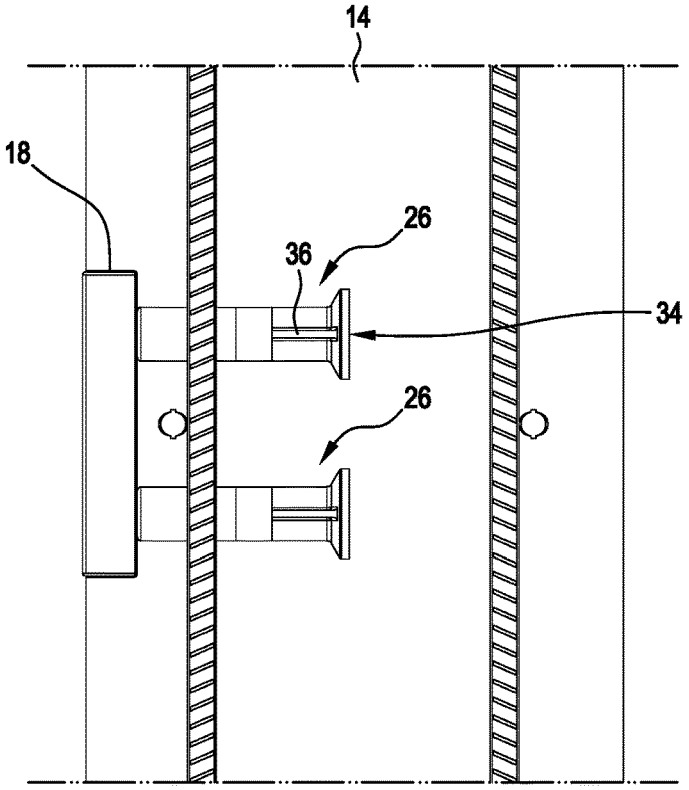
FIG. 15 shows an end view of a rebate former embedded in a first concrete component.
Figure 16:
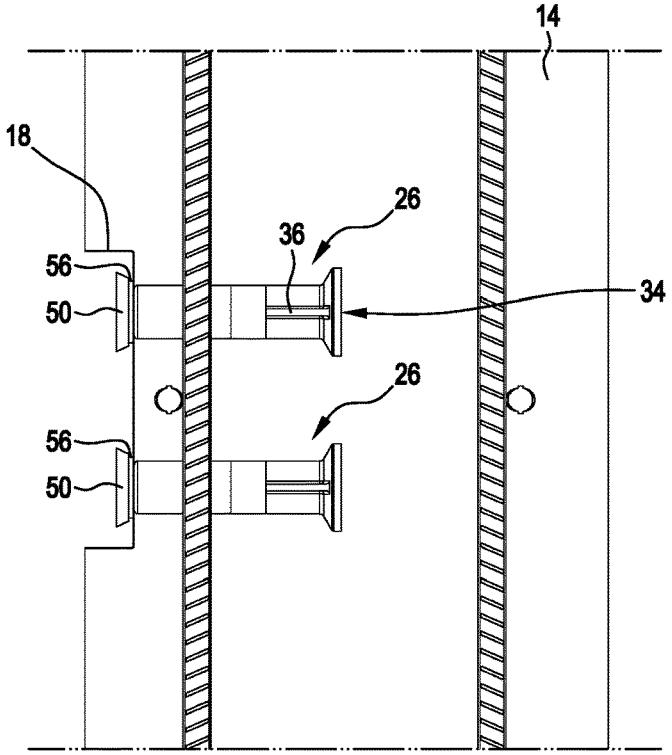
FIG. 16 shows the rebate former of FIG. 15 shown with threaded plugs fitted.
Figure 17:
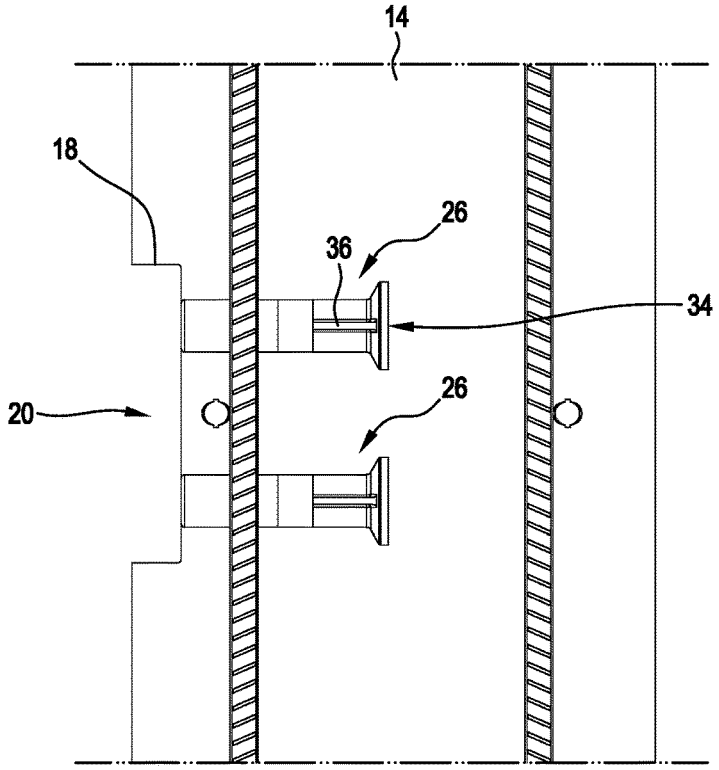
FIG. 17 shows the rebate former of FIG. 16 with the plugs removed.

The rebate former 18 may include a row of anchors 26 mounted longitudinally of the rebate former 18 (see, for example, FIG. 12). In another form, the rebate former 18 may include a plurality of parallel rows of anchors 26 mounted longitudinally of the rebate former 18 (see, for example, FIG. 13).

Figure 4:
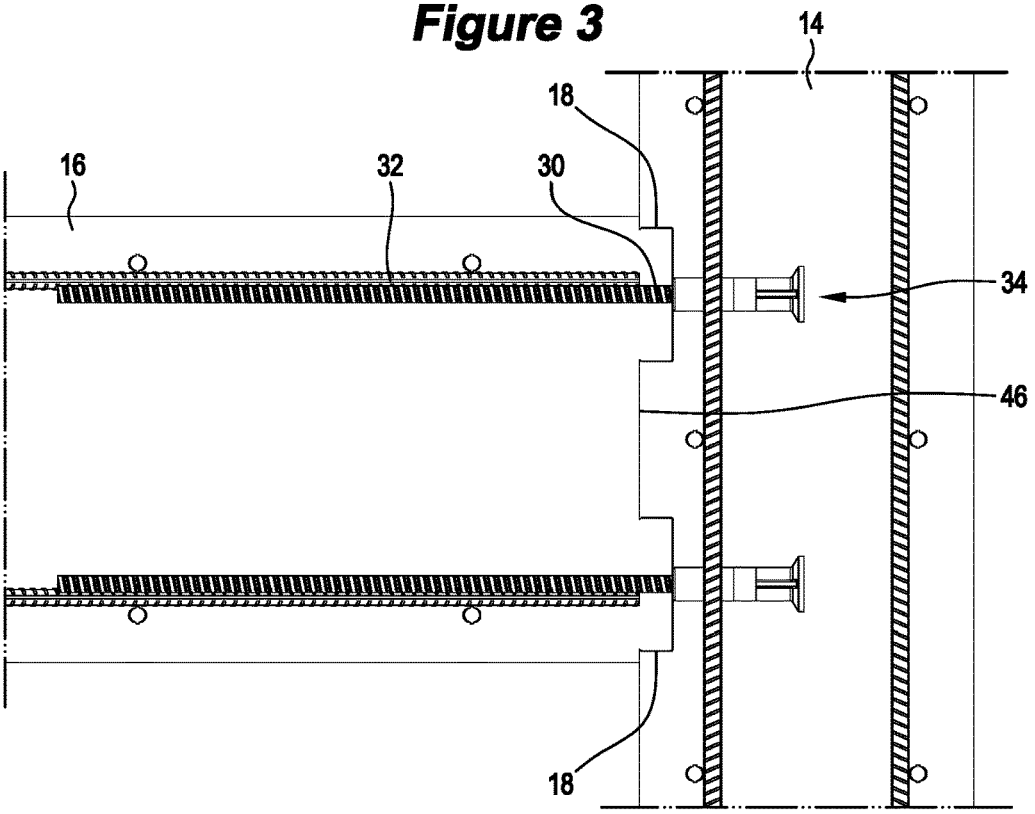
FIG. 4 is a cross-sectional view of a connection system having a pair of parallel rebate formers.
Figure 5:
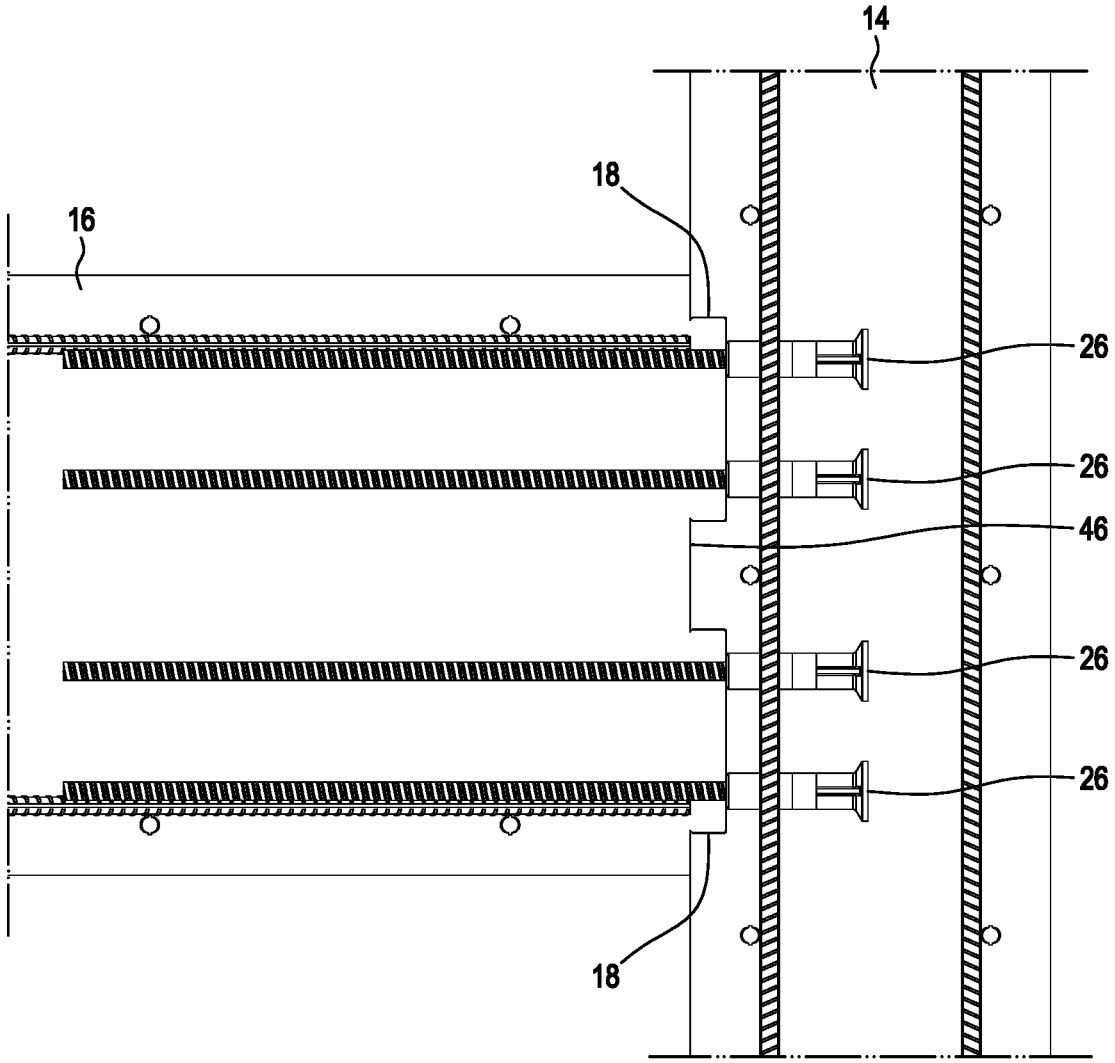
FIG. 5 is a cross-sectional view of a connection system having a pair of parallel rebate formers, each with parallel rows of anchors.

The connection system 10 may include a plurality of parallel rebate formers 18 joined by an intermediate section 46, as shown in FIG. 4. Each rebate former 18 may have a plurality of rows of anchors 26 mounted thereto, as shown in FIG. 5.

Figure 6:
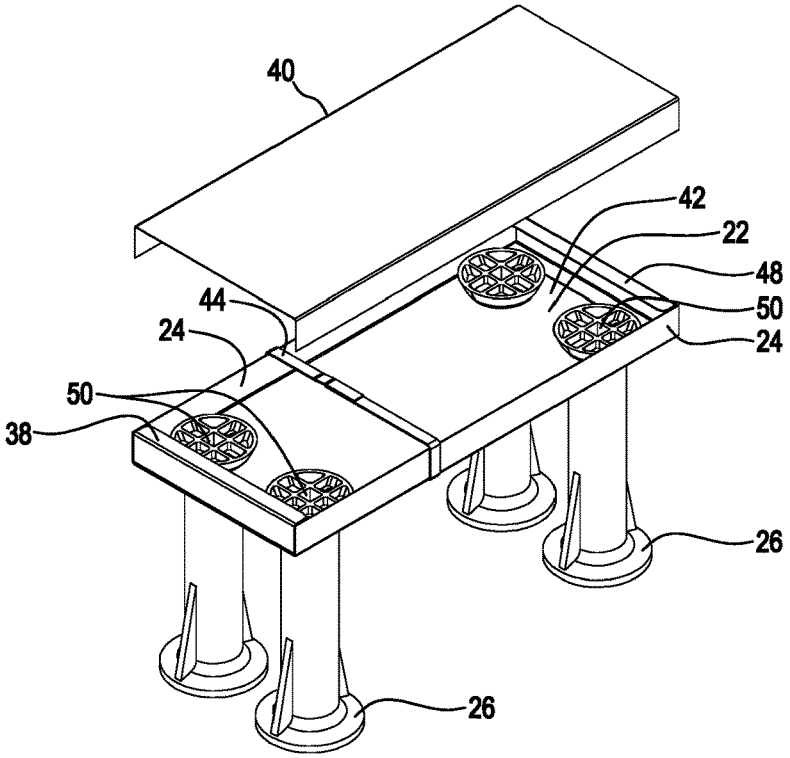
FIG. 6 is a perspective view of a connection system, showing an internal cavity beneath a lid.

With reference to FIG. 6, the rebate former 18 may include a cross strut 48 extending across a width of the internal cavity 42 of the rebate former 18. The cross strut 48 may be in the form of a brace which is movable along a length of the rebate former 18.

Figure 29:
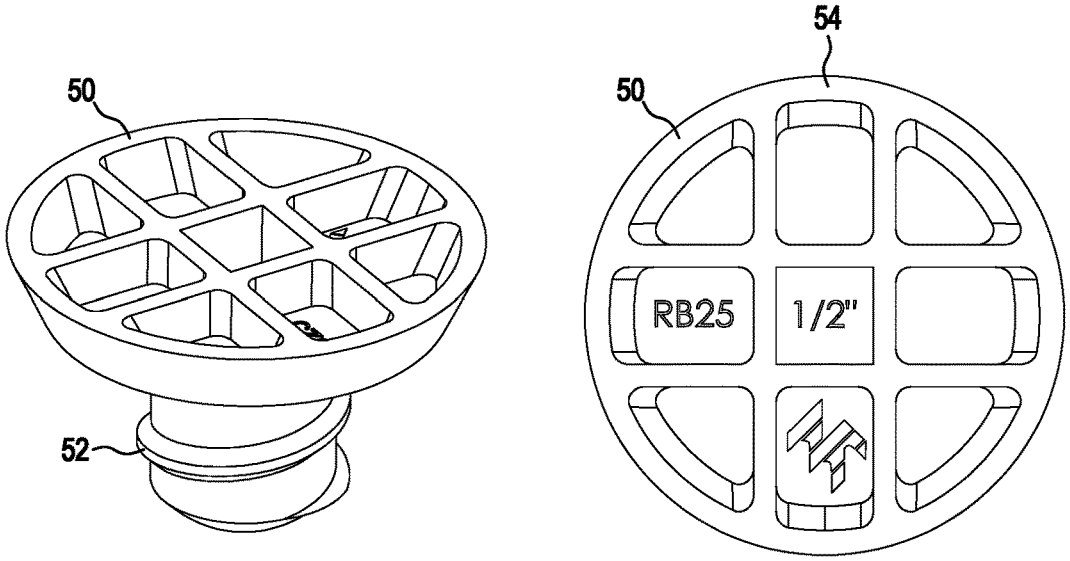
FIG. 29 shows both sides of a threaded plug.

Also as shown in FIG. 6, each anchor 26 may be provided with a securing plug 50, the securing plug 50 having an external thread 52 for threading into the internal thread 28 of the anchor 26. As shown in FIG. 29, the securing plug 50 may have an external thread 52 having the same pitch as the external thread 30 of a reinforcing bar 32 for threading into the internal thread 28 of the anchor 26. This may be advantageous as the external thread 52 is therefore a coarse thread and is much quicker to thread in and thread out the securing plug 50 when compared with a metric thread. The securing plug 50 may be arranged with an enlarged base 54 (see FIG. 29) to facilitate threading manually by hand. In one form, the securing plug 50 is formed of plastic material.

The connection system 10 may include a resilient washer 56 (see FIG. 31 and FIG. 32) located between the securing plug 50 and the respective anchor 26 to facilitate a seal of the internal thread 28 of the anchor 26 against ingress of concrete.

Figure 32:
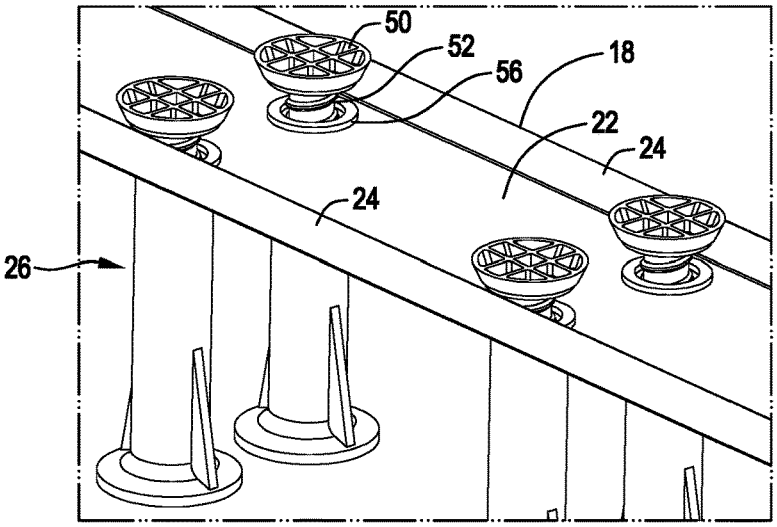
FIG. 32 shows a perspective view of resilient washers is being used to seal beneath threaded plugs.
Figure 33:
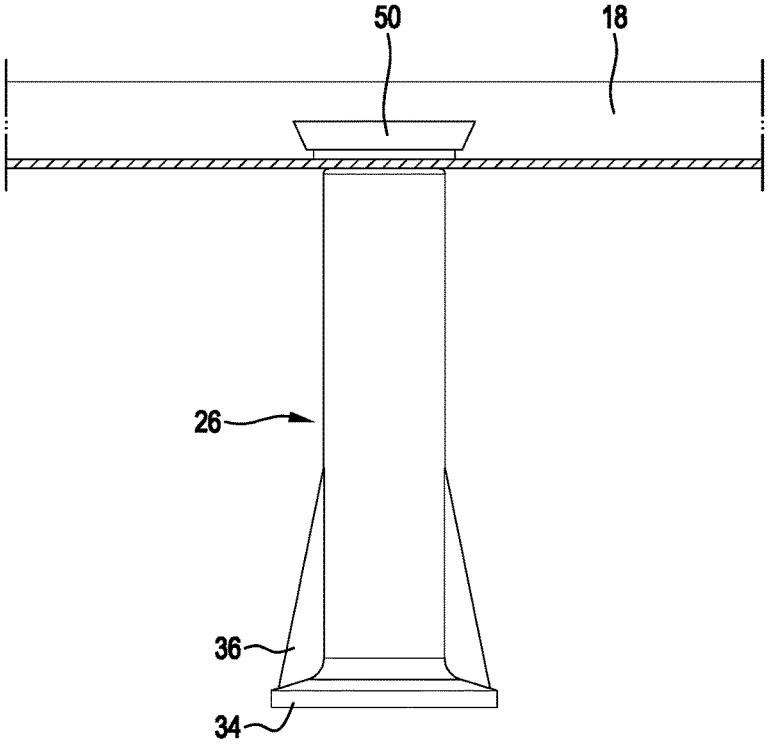
FIG. 33 shows a side view of an anchor fitted to a dimpled rebate former.
Figure 34:
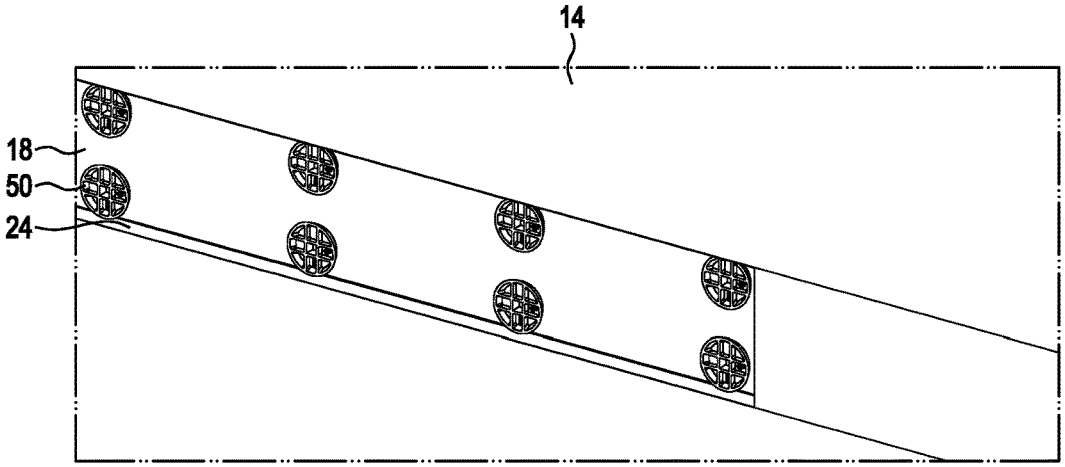
FIG. 34 shows a connection system embedded in a first concrete component prior to removal of threaded plugs.

With reference to FIG. 32, the rebate former 18 may be dimpled on the backing 22 and on the folded edges 24 to facilitate retention of the rebate former 18 within surrounding concrete.

Figure 18:
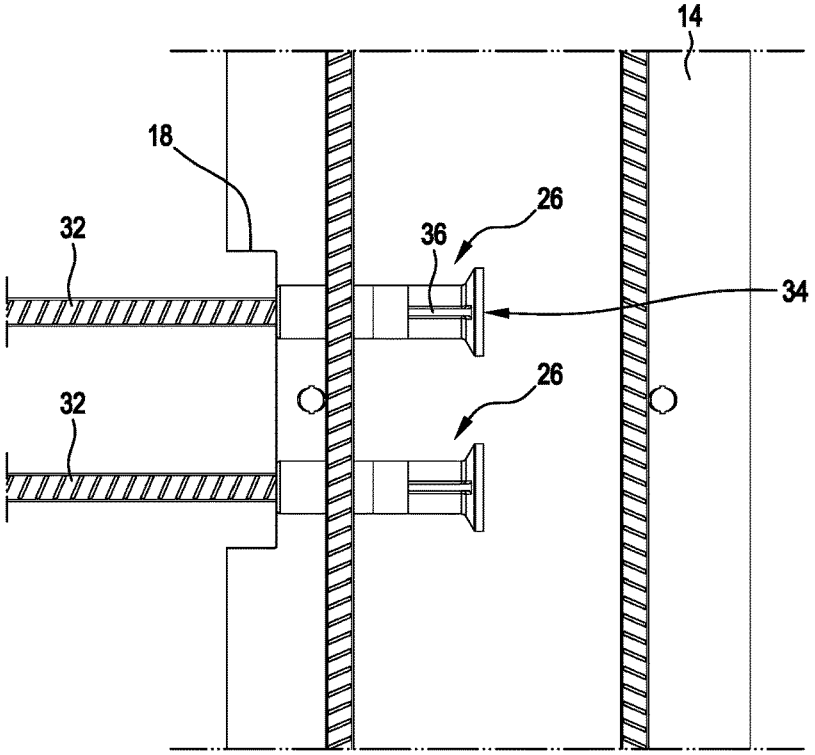
FIG. 18 shows the rebate former of FIG. 17 with reinforcing bars inserted.
Figure 19:
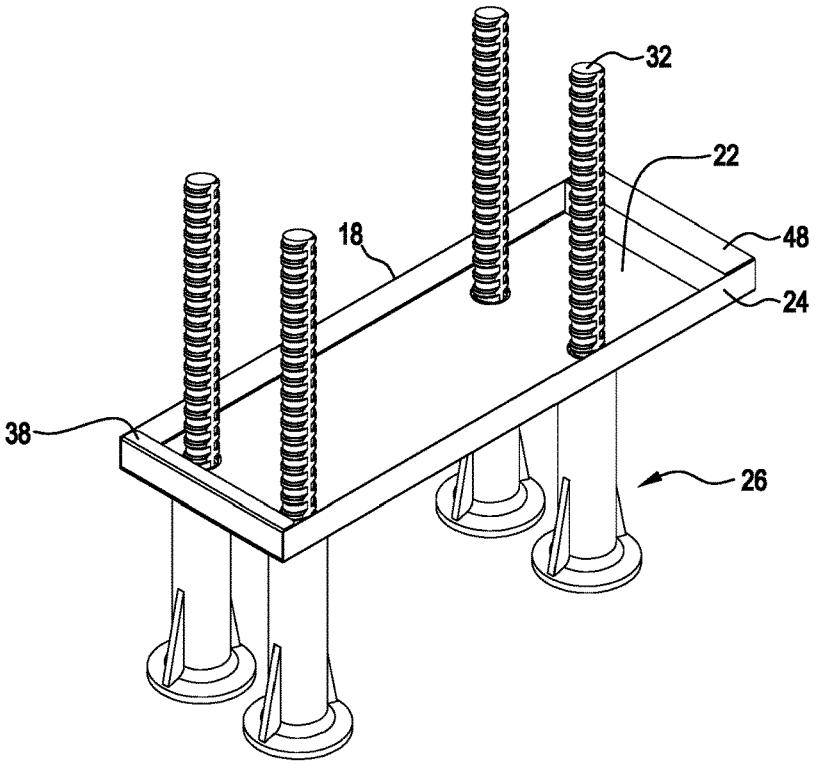
FIG. 19 shows a rebate former cavity shown with a cross strut/brace.
Figure 22:
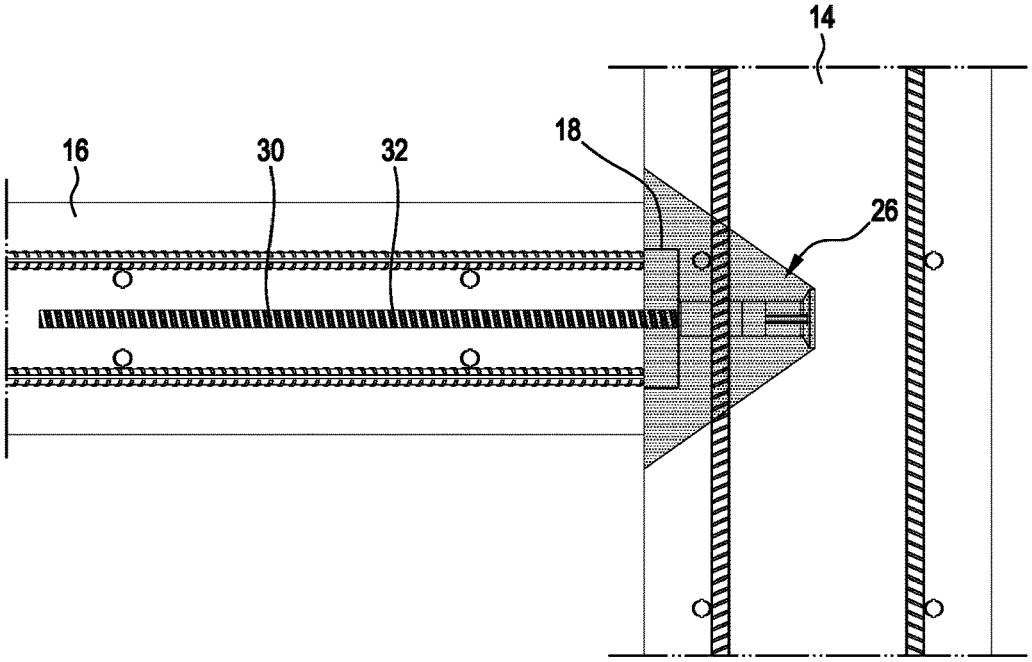
FIG. 22 shows a rebate former used with a single row of anchors.
Figure 23:
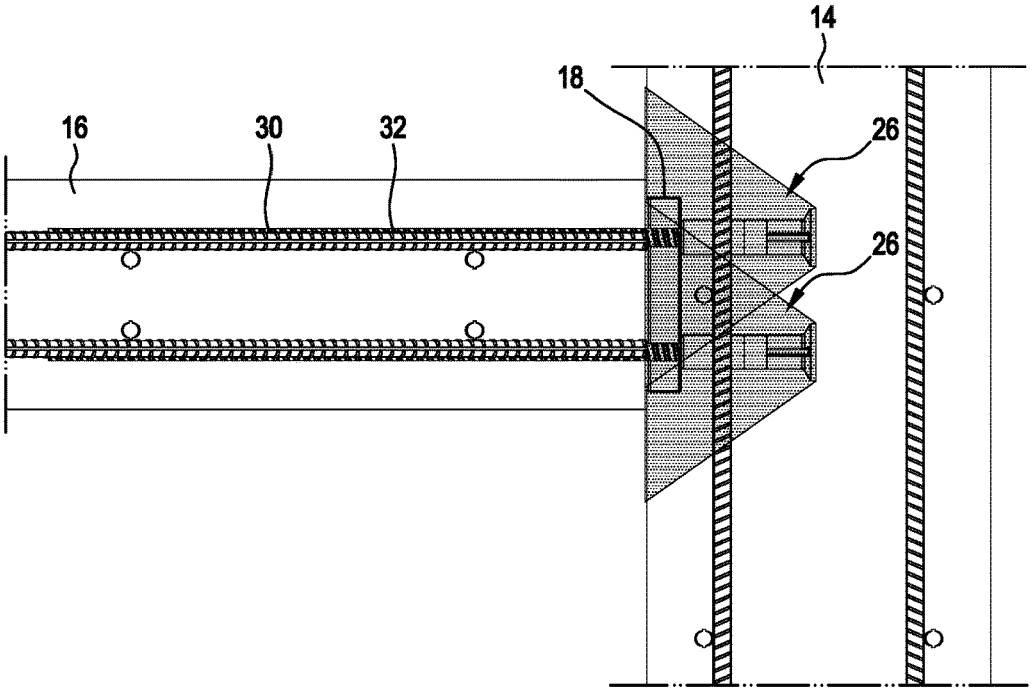
FIG. 23 shows a rebate former used with a double row of anchors.
Figure 24:
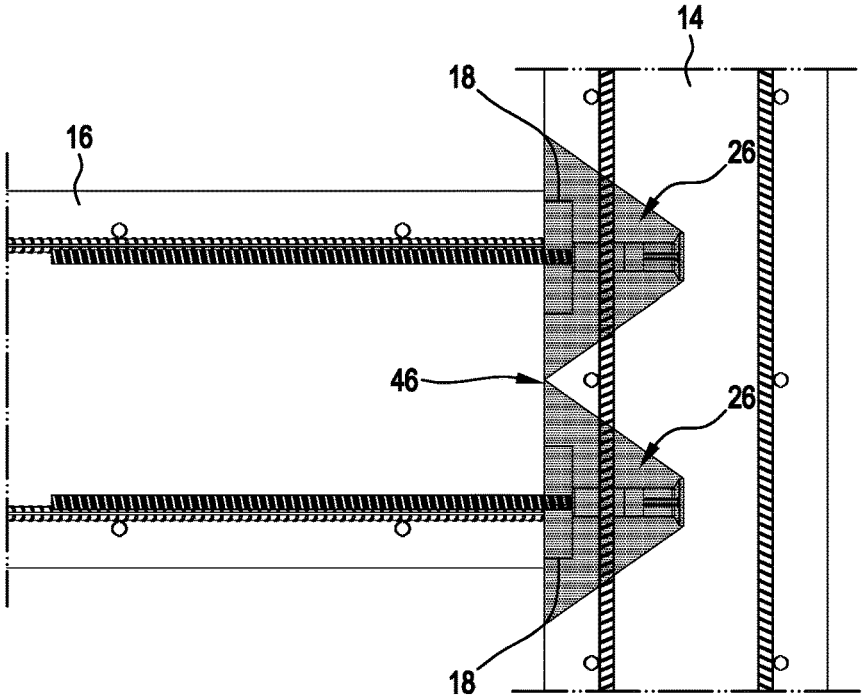
FIG. 24 shows a pair of rebate formers used, each with a single row of anchors.
Figure 25:
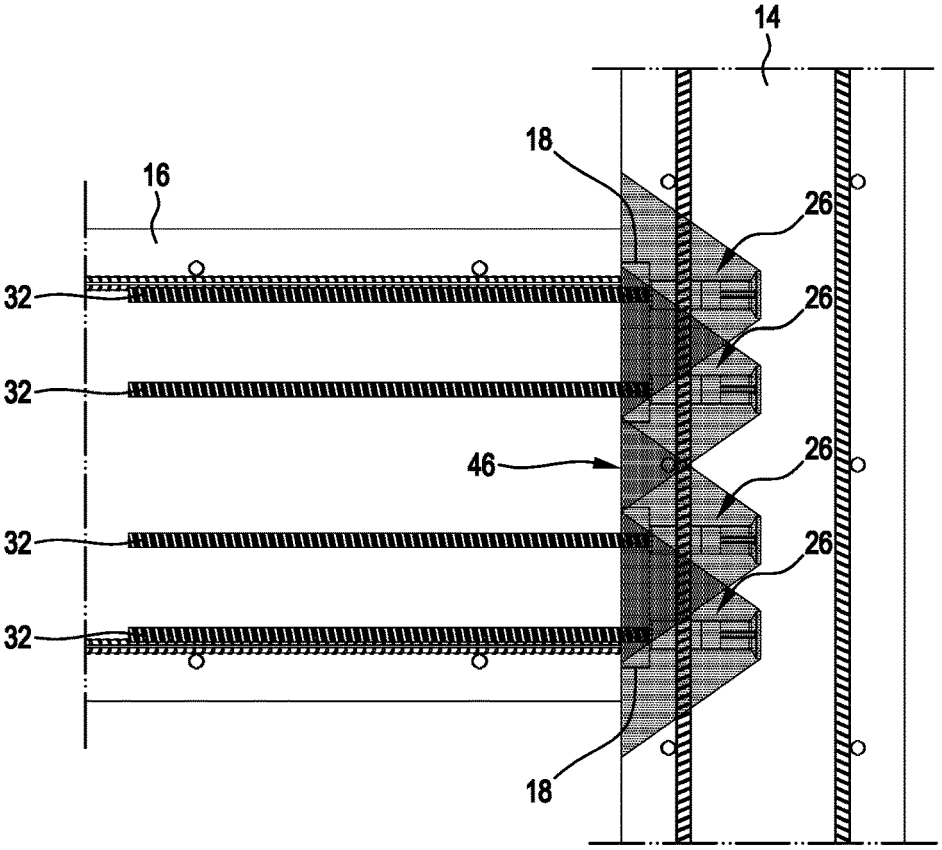
FIG. 25 shows a pair of rebate formers used, each with a double row of anchors.
Figure 26:
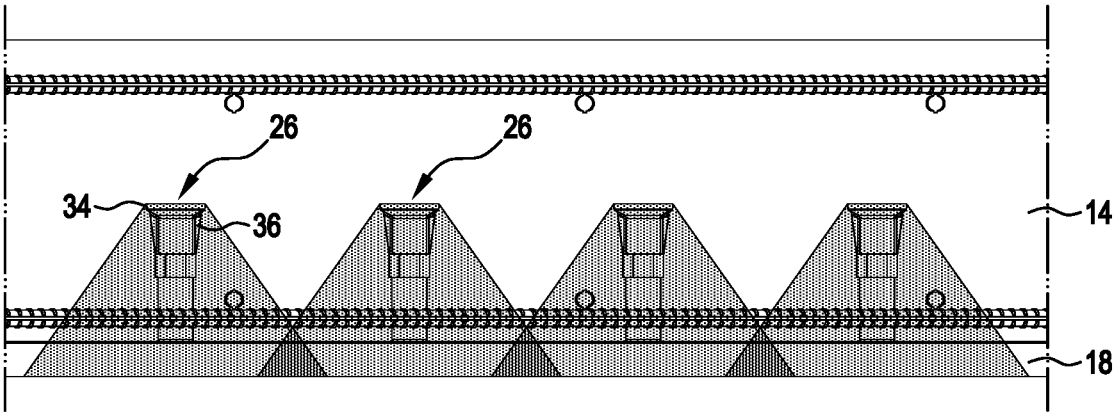
FIG. 26 shows a side view of a rebate former, depicting anchorage.
Figure 27:
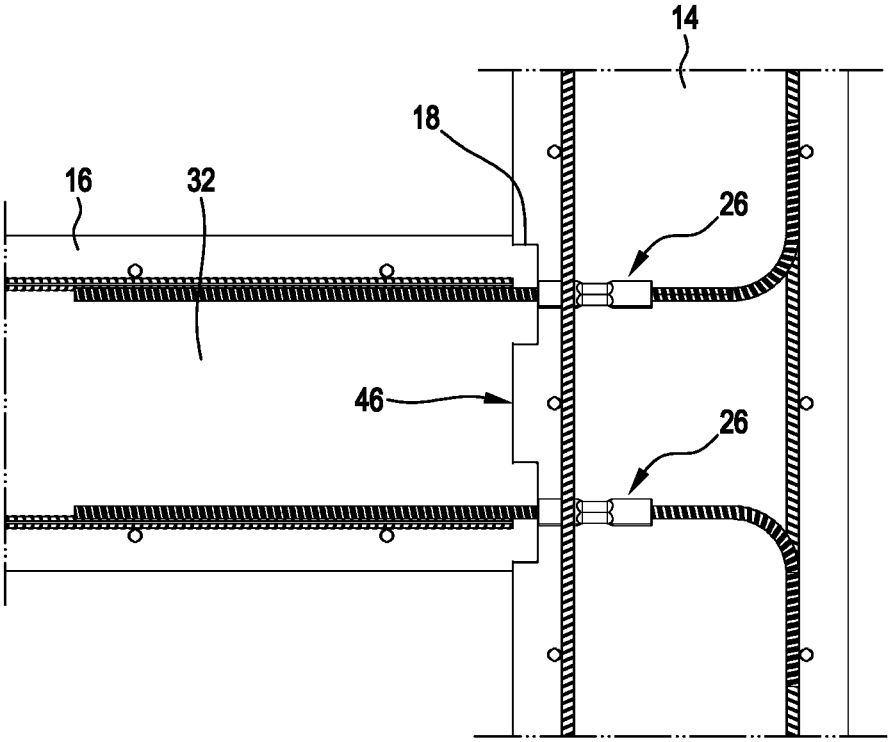
FIG. 27 shows a pair of rebate formers used, each with a single row of double ended anchors.

After casting of the first concrete component 14 and removal of the securing plugs 50, the connection system 10 includes a threaded reinforcing bar 32 threaded into each anchor 26, with an external thread 30 of the threaded reinforcing bar 32 mating with an internal thread 28 of the anchor 26 (see FIG. 18).

Advantageously, as the anchors 26 provided with a coarse thread for threaded insertion of externally threaded reinforcing bar 32, this facilitates direct insertion of the reinforcing bar 32 into the internal thread 28 of each anchor 26 rather than requiring a metric thread to be tapped on to an end of the reinforcing bar 32. This may be advantageous as it may facilitate cutting on-site of a reinforcing bar 32 to size, then threading of the cup and of the reinforcing bar 32 directly into the anchor 26 without needing to form a metric thread on an end portion of the reinforcing bar 32.

Accordingly, various embodiments of the present disclosure also provide a method of providing a construction joint 12 between a first concrete component 14 and a second concrete component 16. The method includes: (1) providing a connection system 10 including a rebate former 18 for forming a rebate 20 in the first concrete component 14, wherein the rebate former 18 is formed of sheet metal, the rebate former 18 including an elongated backing 22, the elongated backing 22 having folded edges 24 to a predefined depth; (2) providing a plurality of anchors 26 coupled to the elongated backing 22, each of the anchors 26 having an internal thread 28; (3) providing a plurality of reinforcing bars 32, each of the reinforcing bars 32 having an external thread 30 along its length; and (4) threading one of the reinforcing bars 32 into each of the anchors 26 such that, for each anchor 26, an external thread 30 of a reinforcing bar 32 is threaded into the internal thread 28 of the anchor 26 to tighten the reinforcing bar 32 relative to the anchor 26 for providing reinforcement for the second concrete component 16.

The following features and/or advantages may be present in examples of the present disclosure, according to the following aspects:

Modular Unit Placement

- Pre-assembled unit ready pick and place onsite installation directly to formwork.
- Removes the requirement to drill through shuttering onsite.
- Flexibility of placement onsite vertical and horizontally.
- Standard single row configuration units to suit smaller slab sizes (140 mm to 180 mm) with centrally placed lap bars.
- Standard double row configuration units to suit medium to large sized slabs (190 mm to 500 mm) with top and bottom lap bars.
- Multiple row placement ability with single row configuration units to suit extra-large slab sizes (500 mm plus). Rows placed at top and bottom of slab. Added ability to place different anchor sizes for top and bottom reinforcing.
- Multiple row placement ability with double row configuration units to suit extra-large slab sizes (500 mm plus). Rows placed at top and bottom of slab. Added ability to place different anchor sizes for top and bottom reinforcing.
- Standard 1000 mm unit length to facilitate simple take-off and ordering. The units can be cut onsite into infills to match specific length requirements. Internal supports can be moved to block cut ends.
- Standardized predefined rebate depth of 30 mm to suit unit placement before first lay of reinforcing in the wall.

Modular Anchor Placement

- Units use a perforated sheet metal base, punched as a template which accurately spaces and configures structural anchors or couplers at required centers laterally across the joint and spaces them at cover requirements for top and bottom reinforcing (on double row configurations).
- Available in different anchor sizes (RB12, RBA16, RB20, RBA20, RB25 and RB32).
- Optimized anchor/coupler centers to meet connection design parameters.
- Unit base assembly restrains attached coupler/anchors perpendicular the rebated joint face.
- The refined 30 mm rebate positions the anchors at the optimal embedment depth in the wall to provide maximum shear cone efficiency.
- Rebated channel provides added positive shear resistance.

Threaded Lap Bars

- Screw in structural 500 MPa lap bars for easy connection onsite.
- Optional full-length lap bar connection to floor to wall continuality system through use of a full length threaded structural reinforcing bars or a screw on coupler connection system. This reduces lapping at lap bars giving reduced bars cost of overlapping bars and congestion in reinforcing.

Lap lengths are not limited by what can fit into the box lengths (i.e., bar laying in typical pull-out bar systems). This allows the standard 1000 mm box length to be cut to any shorter infill length with easy and allows for fully developed lap lengths on these shorter lengths.

Reduction in weight of continuity systems during setup and transport.

Reduces exposure of tripping hazards created by pull-out bars systems.

Improves installer exposure to repetitive stress injuries caused by bending out multiple pull-out bars.

Optimized Bar Anchorage

Headed anchorage rather than looped or cogged reo lap bars being tied into vertical reinforcing. The 30 mm predefined rebates places the anchors at the correct embedment to maximize shear cone size and efficiency in the placed-in slab.

Cogged anchor of design development length for correct embedment when used with coupler fittings.

The structural anchors used are genuine Reidbar fittings optimized for use with structural Reidbar. They are manufactured to the highest quality and tolerance to match the connecting bar. When tested in concrete against theoretically calculated alternative systems they achieve up to a 30% increase in efficiency over the other systems allowing for a reduction in anchor quantities required for connections. This reduces cost of fittings and labor as well as reducing reinforcing congestion.

Anchors optimized in centers and layers in prefabricated units to give maximum anchorage performance with minimal in place anchors.

Standard anchor application suitable for all types rebated structural connections on multi-level projects: (1) floor to wall; (2) wall to wall; (3) precast panel to floor; (4) precast panel to wall; (5) wall to capping slab; (6) crane penetrations; (7) stair flights and landings; (8) corbels; and (9) beam to wall/column.

Securing Nailing Plate and Washer

Secures couplers or anchors to the unit assembly with a bolt and nut functionality during setup with formwork and pouring of concrete.

Easy attachment during manufacturing and removal onsite of nailing plates from couplers/anchors using a ½" driver and cordless drill.

Nailing plate thread matches the thread of coupler/anchor and blocks void and thread profile during the concrete pour to prevent concrete slurry ingress into the fitting.

Sizes available in to suit RBA16, RB20, RBA20, RB25 and RB32 Reidbar couplers and anchors.

Rubber washer fits between coupler/anchor and nailing plate to create a secure seal to prevent slurry ingress into the rebate box unit during the concrete pour.

Washer acts as an anti-vibration device for the nailing plates to ensure coupler/anchor remains tight until pouring.

Dimpled Unit Base

Dimpled finish on unit base helps anchors base component into the slab when stripping lid.

The dimpled finish maximizes the contact surface area between connecting slabs by up to 5%.

Eliminates need for scabbling rebate.

Made of galvanized sheet metal to prevent corrosion in the rebate.

While various embodiments of the present disclosure have been described above, it should be understood that they have been presented by way of example only, and not by way of limitation. It will be apparent to a person skilled in the relevant art that various changes in form and detail can be made therein without departing from the spirit and scope of the present disclosure. Thus, the present disclosure should not be limited by any of the above-described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

LIST OF NUMBERED FEATURES

Connection system 10
Construction joint 12
First concrete component 14
Second concrete component 16
Rebate former 18
Rebate 20
Elongated backing 22
Folded edges 24
Anchors 26
Internal thread 28
External thread 30
Reinforcing bar 32
Foot 34
External ribs 36
Folded end 38
Lid 40
Internal cavity 42
Strap 44
Intermediate section 46
Cross strut 48
Securing plug 50
External thread 52
Enlarged base 54
Resilient washer 56

The invention claimed is:

1. A connection system for providing a construction joint between a first concrete component and a second concrete component, the connection system comprising:

a rebate former configured to form a rebate in the first concrete component, the rebate former including an elongated backing, the elongated backing including:

an internal surface, an external surface, and folded edges to a predefined depth, wherein the rebate former is formed of sheet metal;

a securing plug including an external thread; and an anchor including a body having a first end, a second end, and an internal thread, wherein the internal thread of the anchor is configured to mate with the external thread of the securing plug, wherein when the internal thread of the anchor mates with the external thread of the securing plug, the first end of the anchor engages the external surface of the elongated backing, and wherein securing plug is removable from the anchor after the first concrete component is formed, and thereafter a reinforcing bar is receivable in the anchor and configured to reinforce the second concrete component.

2. The connection system of claim 1, wherein the internal thread of the anchor is configured to mate with an external thread of the reinforcing bar.

3. The connection system of claim 1, wherein the second end of the anchors has a foot configured to provide anchorage in the first concrete component.

4. The connection system of claim 3, wherein the foot is a tapered foot.

5. The connection system of claim 4, wherein the foot is a circular tapered foot.

6. The connection system of claim 1, wherein the anchors has an external ribs along a length of the body of the anchor, the external ribs configured to provide anchorage in the first concrete component.

7. The connection system of claim 6, wherein the external rib of the anchor is tapered outwardly toward the second end of the anchor.

8. The connection system of claim 1, wherein the anchors includes a threaded insert.

9. The connection system of claim 1, wherein the rebate former includes folded ends.

10. The connection system of claim 1, wherein the connection system includes a lid configured to cover an internal cavity of the rebate former defined by the elongated backing and the folded edges.

11. The connection system of claim 10, wherein the connection system includes at least one strap extending around the rebate former and the lid to secure the lid to the rebate former.

12. The connection system of claim 1, wherein the rebate former includes a row of anchors mounted longitudinally of the rebate former.

13. The connection system of claim 1, wherein the rebate former includes a plurality of parallel rows of anchors mounted longitudinally of the rebate former.

14. The connection system of claim 1, wherein the connection system includes an additional rebate former, wherein the rebate former and the additional rebate former are joined by an intermediate section.

15. The connection system of claim 14, wherein the rebate reformer and the additional rebate former each have a plurality of rows of anchors mounted thereto.

16. The connection system of claim 1, wherein the rebate former includes a cross strut extending across a width of an internal cavity of the rebate former.

17. The connection system of claim 1, wherein the connection system includes a separate threaded reinforcing bar threadable into the anchor.

18. A method of providing a construction joint between a first concrete component and a second concrete component, the method comprising:

providing a connection system including a rebate former configured to form a rebate in the first concrete component, wherein the rebate former is formed of sheet metal and, the rebate former includes an elongated backing, the elongated backing including an internal surface, and external surface, and folded edges to a predefined depth;

providing a securing plug, the securing plug including an external thread;

providing an anchors, wherein the anchor includes a body having a first end, a second end, and an internal thread;

providing a reinforcing bar;

mating the internal thread of the anchor with the external thread of the securing plug such that the first end of the anchor engages the external surface of the elongated backing;

removing the securing plug from the anchor after the first concrete component is formed; and mating the reinforcing bars with the anchor to provide reinforcement for the second concrete component.

19. The method of claim 18, wherein the reinforcing bar includes an external thread, and wherein the method includes mating the internal thread of the anchor with the external thread of the reinforcing bar.

* * * * *